United States Patent [19]

Molinari

[11] 4,175,879

[45] Nov. 27, 1979

[54] TOOTHBRUSH

[76] Inventor: Pietro Molinari, 8, Piazza Foraggi, Trieste, Italy, 34100

[21] Appl. No.: 801,268

[22] Filed: May 27, 1977

[30] Foreign Application Priority Data

May 31, 1976 [IT] Italy ..... 59809/76[U]

[51] Int. Cl.[2] ..... A46B 11/02

[52] U.S. Cl. ..... 401/287; 128/66; 401/289

[58] Field of Search ..... 401/268–291; 128/66, 224, 229

[56] References Cited

U.S. PATENT DOCUMENTS

| | | | |
|---|---|---|---|
| 1,216,239 | 2/1917 | Lovell | 401/287 |
| 1,339,745 | 5/1920 | Dunaway | 401/280 |
| 1,580,799 | 4/1926 | Anzalone | 401/281 |
| 1,928,929 | 10/1933 | Craig | 401/286 |
| 2,793,382 | 5/1957 | Fletcher | 401/272 |
| 3,903,888 | 9/1975 | Buelow et al. | 401/270 |

FOREIGN PATENT DOCUMENTS

| | | | |
|---|---|---|---|
| 1089728 | 10/1954 | France | 401/291 |
| 368494 | 2/1939 | Italy | 401/289 |
| 509464 | 4/1956 | Italy | 401/289 |
| 1990 | of 1903 | United Kingdom | 401/290 |

*Primary Examiner*—Clyde I. Coughenour

*Attorney, Agent, or Firm*—Pollock, Vande Sande & Priddy

[57] ABSTRACT

In a toothbrush which comprises, as usual, a handle and a bristle-carrying portion at one end of said handle, there are provided water dispensing jets or bores in correspondence of said bristle-carrying portion, between the bristle tufts. Said jets or bores communicate with a water inlet connection member provided at the other end of the handle of the toothbrush, said water inlet connection member being connectable, by means of a flexible pipe and of an adaptable elastic joint, to a water tap or faucet.

2 Claims, 7 Drawing Figures

TOOTHBRUSH

SUMMARY OF THE INVENTION

The present invention relates to a toothbrush, and more particularly to a toothbrush of the type which permits the cleaning of the surface of the teeth by the combined action of brushing with toothpaste and of jets of water emitted by the said toothbrush. In this manner it is possible to utilize the cleansing action of water jets alone or in combination with the usual action of the applied and brushed toothpaste. The use of the water jets depends on the user: it is possible therefore either to simply rinse the teeth and subject same to a brushing action, without any toothpaste, or to jointly take advantage of the cleansing action deriving from the brushing with toothpaste and from the water jets, or alternately, to brush the teeth in the usual manner by brushing the teeth with the toothpaste, and then rinsing off the foam and thoroughly cleaning the teeth by means of the water jets.

The novel feature of the invention substantially resides in the fact that the toothbrush presents, arranged between the bristle tufts, one or more water emitting jets or bores which communicate, through a duct or ducts in the handle of the toothbrush, with a water inlet connection member provided at the end of the handle opposite the bristle-carrying end, which connection member is connectable, through a flexible pipe, to a water tap or faucet.

Preferably, the toothbrush according to the invention is constructed of two complementary halves or shells made of plastic, which fit together along longitudinal planes, and which define an inner longitudinal cavity extending from the said water inlet connection member at one end of the handle to a plurality of through bores provided at the bristle-carrying portion, and arranged between the bristle tufts. The said two halves or shells are fitted together by utilizing suitably complementarily shaped portions, and then are joined to one another, for example by glueing or by welding.

Still in accordance with the invention, the duct in the handle communicates with a plurality of parallel ducts in the bristle-carrying portion, and the water dispensing bores or jets are provided at each of said parallel ducts. In this manner, the mechanical resistance of the bristle-carrying portion is improved, and the single water stream coming from the water inlet connection member is advantageously subdivided into a plurality of streams, each serving a separate row of water dispensing bores or jets.

The parallel ducts are formed by a longitudinal rib which is centrally located in the lower half of the handle and which extends substantially the entire distance corresponding to the portion of the upper half of the handle provided with the through bores. This rib not only gives needed rigidity to the toothbrush during use, but is required during manufacturing to prevent cracking of the assembled handle during insertion of the bristles.

BRIEF DESCRIPTION OF THE DRAWINGS

The above and other features and advantages of the invention will be evident from the following description of a preferred embodiment, made with reference to the attached drawings, in which.

DESCRIPTION OF THE PREFERRED EMBODIMENT

Figures 1, 5, 6, 7:
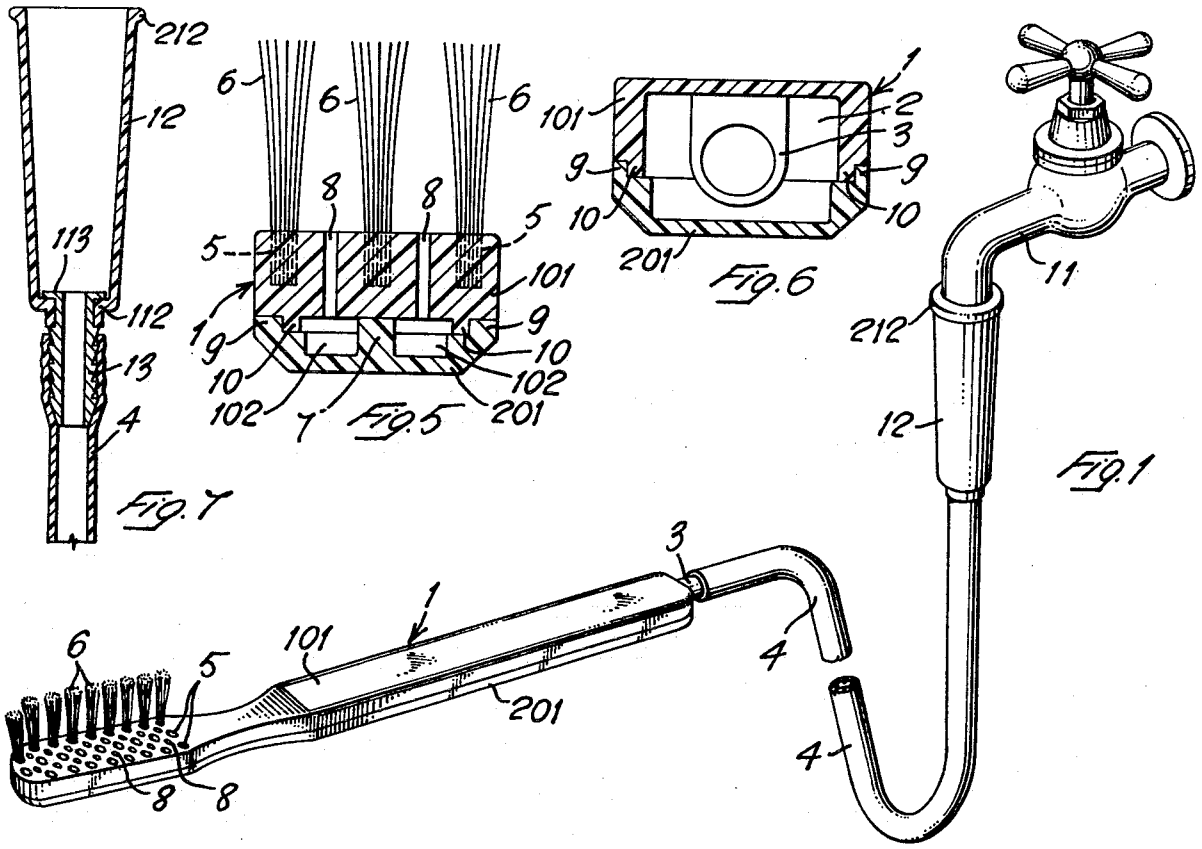
FIG. 1 is a perspective view showing the toothbrush according to the invention connected to a water tap.
FIGS. 5 and 6 are two sections, in an enlarged scale, along lines V—V and VI—VI of FIG. 2.
FIG. 7 shows in vertical section the detachable joint between the flexible small pipe and the water tap.
Figure 2:
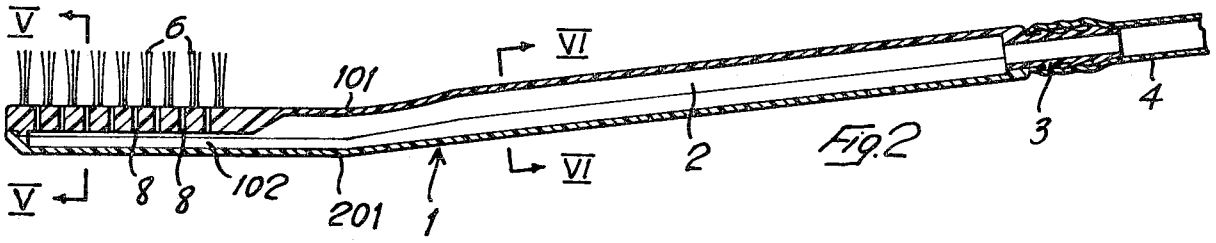
FIG. 2 is a longitudinal section of the toothbrush of FIG. 1.
Figure 3:
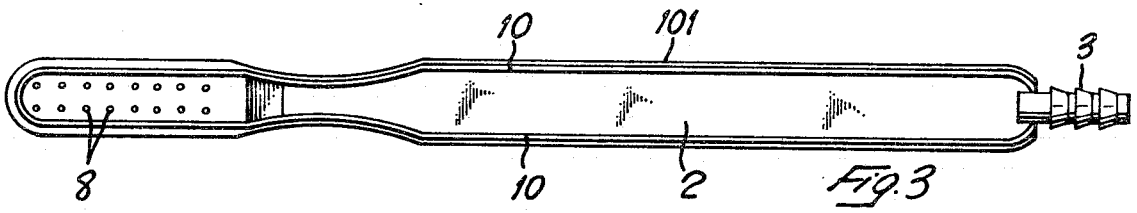
FIGS. 3 and 4 show in plan view the inner side of the two separate halves or shells of the toothbrush.
Figure 4:
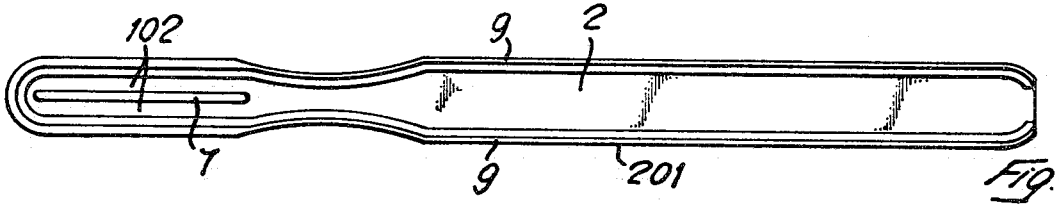

In the drawings, reference numeral 1 indicates a toothbrush the body or handle of which is made of plastic and which consists of two complementary halves or shells 101 and 201 which fit along longitudinal planes and preferably are united by fitting, thus defining an internal cavity 2 which extends along the whole length of the toothbrush. In the shown embodiment, the half 101 of the toothbrush presents at its rear end a tubular inlet connection piece 3 which serves as connection for a small flexible pipe 4, made of rubber or plastic. At its forward end, the half 101 of the toothbrush 1 presents a series of dead holes 5, inside which there are fitted and secured the bristles (bristle tufts) 6 of the toothbrush.

In the area adjacent the bristles 6, i.e., at the forward end zone of the toothbrush, the half 201 provided at its interior with a central longitudinal rib 7 which, upon assembly of the toothbrush by fitting together the two halves 101 and 201, against the inner surface of the other half 101 of the toothbrush. In this manner, in the first place the forward end of toothbrush 1 is mechanically reinforced, preferably in combination with a greater thickness of that portion of the half 101 which carries bristles 6. Moreover, in the forward end zone of toothbrush 1, there are in this manner obtained two ducts 102 which are parallel to one another and which communicate at the front with each other and at the rear with cavity 2. The said cavity 2 occupies the whole width of the toothbrush and extends up to its rear end, where it communicates with the tubular inlet connection piece 3.

In connection with each duct 102 there is provided, in the toothbrush half 101, a row of through bores 8, which permit the flow of water and which open between the tufts of bristles 6.

In the illustrated embodiment, the fitting of the two halves 101 and 201 is accomplished by means of a peripheral projecting edge portion 9 in the form of a step, which extends along the whole perimeter of the half 201 and which is engaged by a corresponding peripheral projecting edge portion 10 provided on the other half 101 of the toothbrush. The two halves or shells 101 and 201 moreover are glued or welded to one another, so as to obtain a single piece which cannot be opened.

The flexible small pipe 4, which is connected by one of its ends to the inlet connection piece 3 of the toothbrush 1, is connected by its other end to a water tap 11. In the illustrated embodiment, the connection between the flexible pipe 4 and the water tap 11 consists of a funnel-shaped elastic joint 12 made of rubber or plastic, provided with a bottom piece 112 presenting a central bore. Inside this bore there is fitted, from the interior of the funnel-shaped joint 12, a tubular connecting member 13 made of rigid material, such as metal or rigid plastic. The said connecting member 13 has an outwardly directed flange portion 113 which bears onto the bottom 112 of joint 12. The funnel-shaped joint is fitted onto the tap by elastically fitting its upper reinforced end 212 onto the said tap 11. It appears evident that, if the shape and size of the water tap should require it, an elastic joint 12 of different dimensions may be easily and quickly substituted.

The operation of the just described toothbrush is as follows. When water tap 11 is opened, the water flows through pipe 4, cavity 2 of the toothbrush and parallel ducts 102, and out through dispensing bores or jets 8 between bristles 6. The water jets emerging from bores 8 may be regulated by simply controlling the flow of water from tap 11. In this manner a more or less strong rinsing or cleaning action may be obtained, and it is to be noted that the toothbrush according to the invention may be advantageously used even without applying toothpaste, since the combined action of the bristles and of the water jets will provide for the thorough cleaning of the teeth and gums of the user, also effecting (depending upon the pressure of the water) an hydraulic gum massage.

Moreover, the water jets flowing out of bores 8 will maintain the bristles clean and wash away the toothpaste which always tends to adhere and stick to the bristles of ordinary toothbrushes, no matter how carefully they are rinsed.

I claim:

1. A toothbrush comprising (a) a handle having a portion carrying a plurality of rows of bristles at one end thereof, and a duct extending longitudinally through said handle;

(b) at least two rows of water-dispensing bores in between said rows of bristles;

(c) a water inlet connecting member being provided at the other end of said handle and communicating with said bore via said duct, said connecting member being connectable, by means of a flexible tube, to a water supply source;

(d) said handle comprising first and second longitudinal plastic halves, the first said half having said at least two rows of bores between said rows of bristles, the second said half being designed for complementary fit with the first said half and having a longitudinal substantially centrally located rib extending continuously substantially the length of said rows of bores and abutting the first said half, whereby said duct is divided into two parallel ducts extending longitudinally below said bristle-carrying portion and separating said rows of bores.

2. A toothbrush according to claim 1, in which said flexible tube is connected to said water supply source by means of funnel-shaped joint made of elastic material, so that it can be easily adapted to a said water supply source of any dimensions.

* * * * *